United States Patent [19]

Konchan et al.

[11] Patent Number: 5,054,827

[45] Date of Patent: Oct. 8, 1991

[54] VEHICLE DOOR LATCH

[75] Inventors: Jeffrey L. Konchan, Clarkston; Jiri Paulik, Sterling Heights, both of Mich.

[73] Assignee: General Motors Corporation, Detroit, Mich.

[21] Appl. No.: 494,002

[22] Filed: Mar. 7, 1990

[51] Int. Cl.[5] ..... E05C 3/26

[52] U.S. Cl. ..... 292/216; 292/DIG. 26

[58] Field of Search ..... 292/216, 280, DIG. 26, 292/DIG. 27, 336, 3

[56] References Cited

U.S. PATENT DOCUMENTS 3,365,226 1/1968 Shay ..... 292/DIG. 26 X
3,614,146 10/1971 Marx ..... 292/DIG. 26 X
3,804,441 4/1970 Kobayashi et al. .... 292/DIG. 26 X
4,756,563 7/1988 Garwood et al. ..... 292/216

*Primary Examiner*—Richard E. Moore
*Attorney, Agent, or Firm*—Herbert Furman

[57] ABSTRACT

The operating member of an uncoupling type vehicle door latch has a blocking portion which blocks movement of the coupling means to uncoupled position when the door latch is in unlatched position unless the operating member is first moved to an operated position. This requires the performance of multiple conscious actions by the driver in order to obtain keyless locking. The coupling means can be returned to coupled position by the locking means without operation of the operating member.

8 Claims, 2 Drawing Sheets

VEHICLE DOOR LATCH

BACKGROUND OF THE INVENTION

This invention relates generally to vehicle door latches and more particularly to a vehicle door latch having a blocking arrangement for selectively blocking movement of the coupling means of the door latch to uncoupled position when the vehicle door is in an open position.

Door latches of the coupling/uncoupling type include a coupling means coupling the detent for the latch bolt with an unlatching member. The movement of the coupling means to coupled and uncoupled positions with respect to the unlatching member is controlled by locking means which may be power or manually operated from inside and outside the vehicle. When the coupling means is in uncoupled position, movement of the unlatching member by the inside or outside operator is ineffective to release the detent from the latch bolt. Keyless locking can be obtained by operating the locking means to move the coupling means to an uncoupled position when the vehicle door is in an open position, and thereafter closing the door.

It may be desirable in certain vehicles to prevent obtainment of keyless locking of the driver's door through one conscious action and require that the driver perform more than one conscious action in order to move the coupling means to uncoupled position when the vehicle door is in open position.

The door latch of this invention is of the coupling-/uncoupling type and requires that the driver sequentially perform a number of conscious actions in order to obtain keyless locking. This prevents inadvertent keyless locking of the driver's door.

In the preferred embodiment of the invention, the unlatching member is provided with a blocking portion. The unlatching member is conventionally moved between a non-operating position and an operating position by either an inside or an outside operator, such as a handle or power operator. When the door is in open position and the latch bolt is in unlatched position, the unlatching member is positioned in a non-operating position wherein its blocking portion is located in the path of the coupling means to block movement of the coupling means to uncoupled position. If the driver wishes to obtain keyless locking, the driver must first operate the inside or outside operator to move the unlatching member from the non-operating position to the operating position to locate the blocking portion of the unlatching lever in unblocking position. The driver then operates the inside or outside locking member to move the coupling means to uncoupled position, and then closes the door. The inside or outside operator can be released as soon as the coupling means is moved to uncoupled position. By requiring the driver to first consciously operate the inside or outside operator and then consciously operate the inside or outside locking member, inadvertent keyless locking of the driver's door is prevented. For added convenience, when the door is in open position, the latch bolt is in unlatched position, and the coupling means has been moved to the uncoupled position, the coupling means can be moved back to coupled position by the inside or outside locking member without need to operate the inside or outside operator. Thus, two conscious actions are required to move the coupling means to uncoupled position and obtain keyless locking, but only one conscious action is required to return the coupling means to coupled position.

The primary feature of this invention is that it provides a vehicle door latch wherein the driver must sequentially perform a number of conscious actions in order to obtain keyless locking of the vehicle door latch. Another feature is that the door latch is of the coupling/uncoupling type and the coupling means of the door latch is blocked from movement to uncoupled position when the door is in an open position and the door latch is in unlatched position. A further feature is that the coupling means is operated by an unlatching member which blocks movement of the coupling means to uncoupled position when the door is in an open position and the door latch is in unlatched position. Yet another feature is that the unlatching member has a blocking portion which blocks movement of the coupling means when the unlatching member is in a non-operating position. Yet a further feature is that the inside or outside operator must first be operated to move the unlatching member to an operating position to locate the blocking portion of the unlatching member in a non-blocking position with respect to the coupling means. Still another feature is that the coupling means can be returned to coupled position without operation of the inside or outside operator. Still a further feature is that the coupling means moves the unlatching member to an operating position when the coupling means is returned to coupled position by locking means. Yet another feature is that the coupling means cams the unlatching member to the operating position when the coupling means is returned to coupled position.

These and other features of this invention will be readily apparent from the following specification and drawings wherein.

Figure 1:
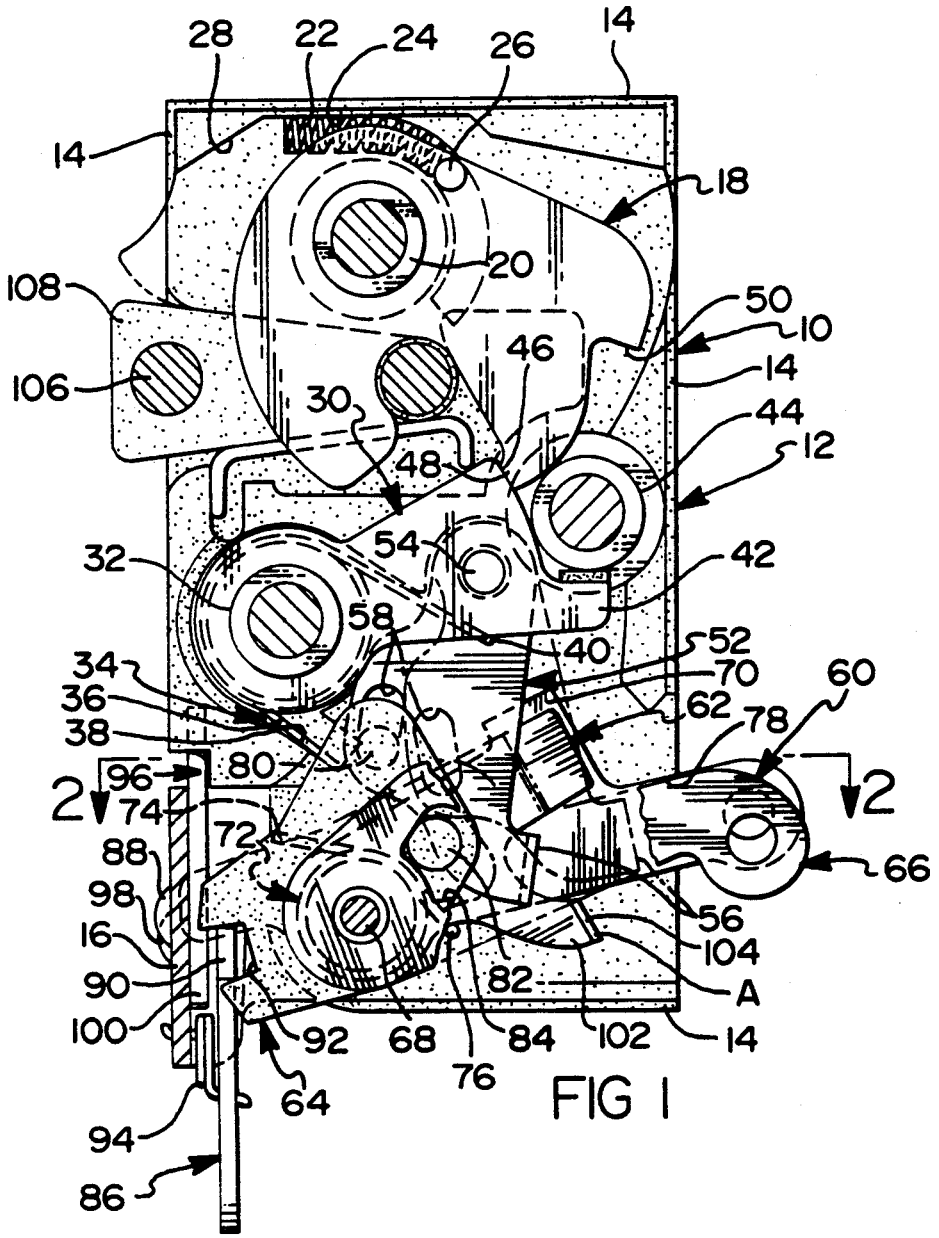
FIG. 1 is a partially broken away view of a vehicle door latch according to this invention in a latched and unlocked condition with the vehicle door in closed position.

Referring now to the drawings, the vehicle door latch 10 shown is substantially the same as that shown and described in U.S. Pat. No. 4,756,563 Garwood et al., Vehicle Door Latch, issued July 12, 1988, and assigned to the assignee of this invention. Therefore, only a brief description necessary for an understanding of this invention will be given and reference may be had to the Garwood et al. patent for further details of the door latch 10.

The latch 10 includes a molded plastic housing member 12 which opens outwardly and has a series of peripheral wall portions 14 along the outer walls thereof. A cover, not shown, fits within the wall portions 14 and includes a lateral extension or side flange 16, FIGS. 1 and 3.

A fork type bolt 18 is pivoted on a bushing 20 which is mounted within the housing member 12. A coil compression spring 22 in a recess 24 of the housing member 12 engages a pin 26 of the latch bolt to bias the bolt clockwise from its latched position shown in FIG. 1, to an unlatched position, shown in FIG. 3, wherein the outer edge of the bolt engages a shoulder 28 of the housing member 12.

The bolt is held in latched position by a detent 30 which is pivoted on another bushing 32 mounted within the housing member 12. The detent is biased counterclockwise by a torsion spring 34 which surrounds the bushing 32 and has one leg 36 anchored in a recess 38 of the housing member and the other leg provided with a lateral terminal 40 which engages the lower edge of the detent. The engagement of a rubber bumpered leg 42 of the detent with another bushing 44 mounted within the housing member 12 locates the detent in detented position under the bias of the spring 34. In detented position, a detent shoulder 46 engages a primary latching shoulder 48 of the bolt 18 to retain the bolt in primary latched position. The detent shoulder 46 is also engageable with a secondary latching shoulder 50 of the latch bolt 18 to retain the bolt in secondary latched position.

An intermittent member 52 is pivoted at 54 to the detent 30 and includes a lower lateral tab 56 and an arcuate slot 58. An outside operating lever 60, an unlatching member or transfer lever 62, a plastic material locking lever 64, and a key cylinder lever 66 are all coaxially mounted on a shouldered stud 68 mounted within the housing member 12. A lateral tab 70 of the outside operating lever 60 engages the upper edge of the transfer lever 62 to pivotally couple the levers 60 and 62. A coil torsion spring 72, FIGS. 3 and 4, surrounds a plastic bushing on the stud 68 and has one leg 74 engaging a wall of the housing member 12 and the other leg 76, FIGS. 2 and 4, hooked under the transfer lever 62 to bias the transfer lever 62 and the outside operating lever 60 counterclockwise about the stud 68 and engage the operating lever 60 with a shoulder 78 of the housing member 12. The outside operating lever 60 is conventionally connected to a manually operable outside operator, such as a pull type, paddle type, or push button type handle which rotates the levers 60 and 62 clockwise to operating position. The engagement of the lower edge of the transfer lever 62 with the lateral tab 56 of the intermittent member 52, when the intermittent member is in coupled position, as shown in FIG. 1, moves the intermittent member downwardly and in turn rotates the detent 30 clockwise about the bushing 32 against the bias of spring 34 to undetented position, not shown, wherein the detent shoulder 46 is out of engagement with the latch bolt shoulder 48 to permit the latch bolt to move to unlatched position under the bias of spring 22.

The locking lever 64 includes a pin 80 received in the arcuate slot 58 of the intermittent member 52 and a pin 82 received in an opening 84 of the key cylinder lever 66. The key cylinder lever 66 is conventionally connected to an outside key cylinder for clockwise movement of the lever 66 between its unlocked position shown, and an unlocked position, not shown, clockwise of its unlocked position. This movement of lever 66 engages the edge of opening 84 with pin 82 to move the locking lever 64 clockwise from its unlocked position as shown to a locked position wherein the pin 80 rotates the intermittent member 52 slightly counterclockwise to uncoupled position shown in dash lines in FIG. 1. In uncoupled position, the lateral tab 56 of the intermittent member 52 is located to the right of the transfer lever 62 to uncouple the transfer lever and outside operating lever 60 from the intermittent member 52.

Figure 2:
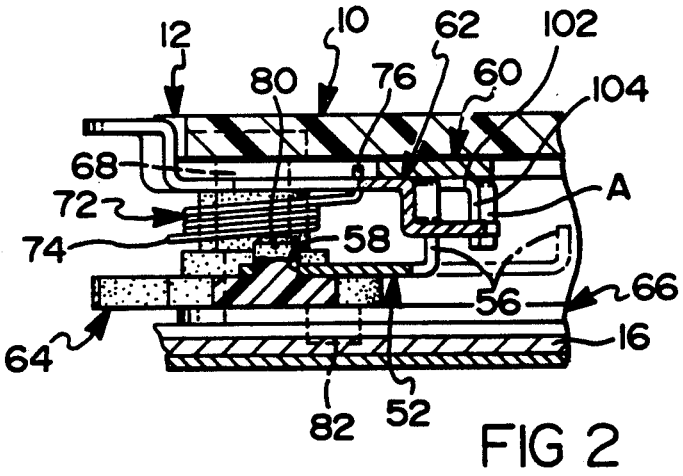
FIG. 2 is a sectional view taken along line 2—2 of FIG. 1.

An inside locking lever 86 is pivoted at 88 to the inner side of the side flange 16 and includes a leg 90 which is received in a slot 92 of the locking lever 64, FIG. 1. An overcenter spring 94 is coup)ed between the lever 86 and the flange 16 to alternately locate the lever 86 in its unlocked position shown, or its locked position, not shown, counterclockwise of its unlocked position, wherein the lever 86 locates the locking lever 64 in its locked position, previously described. The inside locking lever 86 is conventionally coupled to an inside garnish button, lever, or other inside lock operator.

An inside operating lever 96 is pivoted at 98 to the inner side of the flange 16 and is conventionally connected to an inside handle or other operator to locate the lever 96 in its non-operating position The lever 96 includes a foot 100 which underlies the left hand end of the transfer lever 62. When lever 96 is pivoted, the foot 100 engages and rotates the transfer lever 62 clockwise as viewed in FIG. 1. If the intermittent member 52 is in coupled position, the engagement of the lower edge of the transfer lever with the lateral tab 56 of the intermittent member 52 releases the detent 30 as previously described to permit the bolt 18 to move from its latched position of FIG. 1 to its unlatched position of FIG. 3 as the vehicle door moves to open position.

Figure 3:
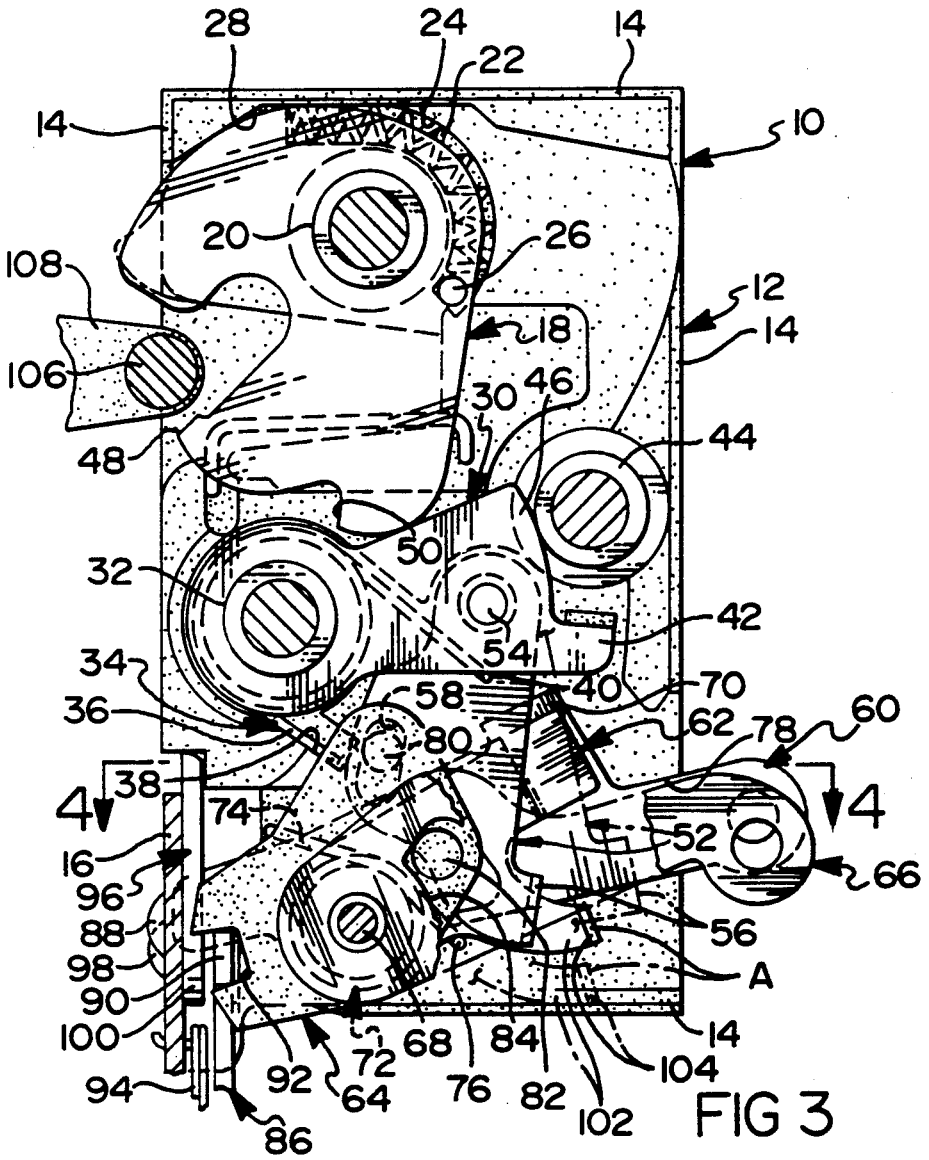
FIG. 3 is a view of the door latch in unlatched and unlocked condition with the vehicle door in open position.
Figure 4:
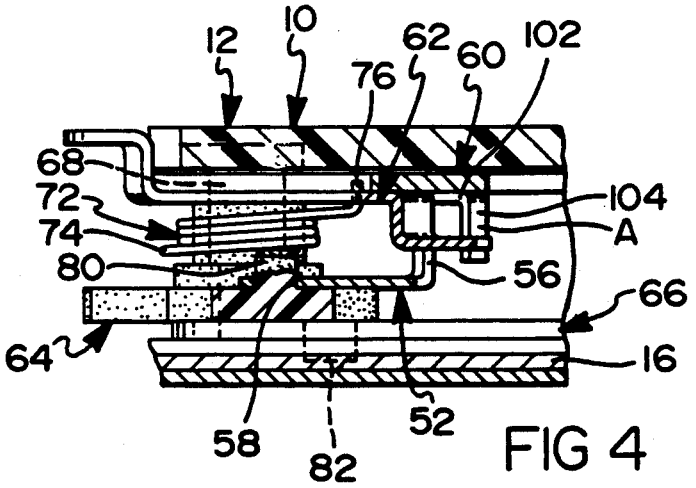
FIG. 4 is a sectional view taken along line 4—4 of FIG. 3.

As shown in FIGS. 1 and 3, the transfer lever 62 is provided with a downwardly extending foot or blocking portion 102 which terminates in a laterally extending foot or tab 104.

When the door latch 10 is in the FIG. 1 latched position, the tab 104 is located below the tab or foot 56 of the intermittent member 52 so that the intermittent member can be moved at will between its uncoupled dash line position and its coupled full line positions without any interference from tab 104.

When the door latch 10 is in the unlatched FIG. 3 position, the tab 104 is located in juxtaposition to foot 56 and blocks movement of the intermittent member 52 to uncoupled position. Thus, the driver or operator cannot obtain keyless locking by moving the intermittent member 52 to uncoupled position through operation of the locking lever 64 by either the lever 66 or the lever 86 and then closing the door.

If the driver or operator desires to obtain keyless locking, the transfer lever 62 must first be rotated slightly clockwise through operation of either the lever 60 or the lever 96 to move the tab 104 to its dash line position shown in FIG. 3 wherein the tab is out of the path of the tab 56 of the intermittent member 52. Thereafter, the intermittent member 52 can be moved to its dash line uncoupled position and the door closed to obtain keyless locking. Once the intermittent member 52 has been moved to its uncoupled position, the transfer lever 62 can be released for return movement to its position shown in FIG. 3. Thereafter the intermittent member 52 can be moved back to coupled position without need to move transfer lever 62 with lever 60. This is because intermittent member acts on cam surface of tab 104 to move transfer lever 62 out of the way.

If it is desired to return the intermittent member 52 to its full line coupled position, the locking lever 64 is operated, as previously described, to rotate the intermittent member 52 clockwise about pivot 54 to coupled position. As the tab 56 engages side A of tab 104, tab 56 cams the transfer lever 62 slightly clockwise due to the angular relationship of the tabs, FIG. 3, as tab 56 slides over and past tab 104. Thus, only one conscious action is necessary to return the intermittent member to coupled position, while two conscious actions are necessary to move the intermittent member to uncoupled position, when the door latch is in unlatched condition.

As shown in FIGS. 1 and 3, the bolt 18 engages one leg of a U shaped striker member 106 when the bolt is in latched position. The striker member is secured to a base 108 which is mounted on the vehicle body pillar, not shown, opposite the swinging end wall of the door, not shown, on which the door latch 10 is mounted. The base 108 is tapered and is received in a like shaped throat of the door latch 10 when the bolt 18 is in latched position. The bolt 10 is moved to its primary or secondary latched position by engagement of the trailing leg of the bolt with the leading leg of the striker member 106, as shown in FIG. 3, when the door is closed.

Thus, this invention provides a vehicle door latch which requires that the driver or operator sequentially perform a number of conscious actions in order to obtain keyless locking. The door latch can be used only on the driver's door or on other doors of the vehicle if desired.

The embodiments of the invention in which an exclusive property or privilege is claimed are defined as follows:

1. In a vehicle door latch including bolt means movable between latched and unlatched positions and detent means movable between detented and undetented positions with respect to the bolt means, the combination comprising, coupling means operatively connected to the detent means for moving the detent means to undetented position to allow movement of the bolt means to unlatched position, operating means operable by an operator, locking means operable to move the coupling means either to a coupled position wherein the coupling means is coupled to the operating means to move the detent means to undetented position upon operation of the operating means or to an uncoupled position wherein the coupling means is uncoupled from the operating means, and blocking means blocking movement of the coupling means to uncoupled position by the locking means when the bolt means is in unlatched position.

2. In a vehicle door latch including bolt means movable between latched and unlatched positions and detent means movable between detented and undetented positions with respect to the bolt means, the combination comprising, coupling means operatively connected to the detent means for moving the detent means to undetented position to allow movement of the bolt means to unlatched position, operating means operable by an operator, locking means operable to move the coupling means either to a coupled position wherein the coupling means is coupled to the operating means to move the detent means to undetented position upon operation of the operating means or to an uncoupled position wherein the coupling means is uncoupled from the operating means, blocking means blocking movement of the coupling means to uncoupled position by the locking means when the bolt means is in unlatched position, and means moving the blocking means to an unblocking position upon movement of the coupling means from uncoupled position to coupled position when the bolt means is in unlatched position.

3. In a vehicle door latch including bolt means movable between latched and unlatched positions and detent means movable between detented and undetented positions with respect to the bolt means, the combination comprising, coupling means operatively connected to the detent means for moving the detent means to undetented position to allow movement of the bolt means to unlatched position, operating means operable by an operator, locking means operable to move the coupling means either to a coupled position wherein the coupling means is coupled to the operating means to move the detent means to undetented position upon operation of the operating means or to an uncoupled position wherein the coupling means is uncoupled from the operating means, and means on the operating means blocking movement of the coupling means to uncoupled position by the locking means when the bolt means is in unlatched position.

4. The combination recited in claim 1 wherein the blocking means includes a blocking foot on the operating means located in the path of the coupling means when the operating means is in a non-operating position.

5. The combination recited in claim 3 wherein operation of the operating means by an operator moves the blocking means to a non-blocking position with respect to the coupling means.

6. The combination recited in claim 2 wherein the coupling means and blocking means have cooperating cam surfaces camming the blocking means to the unblocking position upon movement of the coupling means to coupled position by the locking means.

7. In a vehicle door latch including bolt means movable between latched and unlatched positions and detent means movable between detented and undetented positions with respect to the bolt means, the combination comprising, coupling means operatively connected to the detent means for moving the detent means to undetented position to allow movement of the bolt means to unlatched position, operating means, the combination comprising, coupling means operatively connected to the detent means for moving the detent means to undetented position to allow movement of the bolt means to unlatched position, operating means, locking means operable to move the coupling means either to a coupled position wherein the coupling means is coupled to the operating means to move the detent means to undetented position upon operation of the operating means, or to an uncoupled position wherein the coupling means is uncoupled from the operating means, and blocking means on the operating means located in a blocking position with respect to the coupling means when the bolt means is in unlatched position to block movement of the coupling means to uncoupled position, operation of the operating means when the bolt means is in unlatched position locating the blocking means in an unblocking position to permit movement of the coupling means to uncoupled position.

8. In a vehicle door latch including bolt means movable between latch and unlatched positions and detent means movable between detented and undetented positions with respect to the bolt means, the combination comprising, coupling means operatively connected to the detent means for moving the detent means to undetented position and including an engageable portion, operating lever means movable between operating and non-operating positions by an operator, locking means operable to move the coupling means either to a coupled position wherein the engageable portion of the coupling means is engageable by the operating lever means or to an uncoupled position wherein the engageable portion of the coupling means is out of the path of the operating lever means, a blocking portion on the operating lever means located in the path of the engageable portion of the coupling means when the operating lever means is in non-operating position and the bolt means is in unlatched position to block movement of the coupling means to uncoupled position by the locking means, the engageable portion of the coupling means and the blocking portion of the lever means having cooperating cam surfaces whereby engagement of the engageable portion of the coupling means with the blocking portion upon movement of the coupling means from uncoupled position to coupled position when the bolt mean is in unlatched position cams the lever means to operating position to permit movement of the engageable portion past the blocking means.

* * * * *